US006315360B1

(12) United States Patent
Guerrini

(10) Patent No.: US 6,315,360 B1
(45) Date of Patent: Nov. 13, 2001

(54) DETACHABLE SWIVEL APPARATUS FOR A BEACH CHAIR

(76) Inventor: Derrek Guerrini, 71 Gleason Ave., West Yarmouth, MA (US) 02673

( * ) Notice: Subject to any disclaimer, the term of this patent is extended or adjusted under 35 U.S.C. 154(b) by 0 days.

(21) Appl. No.: 09/487,930

(22) Filed: Jan. 19, 2000

(51) Int. Cl.[7] ..... A47C 1/02
(52) U.S. Cl. ..... 297/344.21; 297/344.26
(58) Field of Search ..... 297/344.26, 256.12, 297/344.21; 248/425, 349.1, 346.01

(56) References Cited

U.S. PATENT DOCUMENTS

D. 340,142 10/1993 Totoro .
2,854,065 * 9/1958 Fox ..... 248/425
2,916,084 * 12/1959 Bottemiller et al. ..... 297/344.26 X
4,720,140 * 1/1988 Change, III ..... 248/349.1 X
4,824,170 * 4/1989 Goldmeier ..... 248/349.1 X
4,842,335 * 6/1989 Wunderlich ..... 297/344.21
5,078,451 1/1992 Sobel .
5,395,157 3/1995 Rollo et al. .
5,931,534 * 8/1999 Hutter ..... 297/344.26 X

* cited by examiner

*Primary Examiner*—Peter M. Cuomo
*Assistant Examiner*—Stephen Vu
(74) *Attorney, Agent, or Firm*—Stephen R. Greiner

(57) ABSTRACT

A swivel apparatus is provided for a folding, beach chair. The apparatus includes a load-distributing platform configured like an inverted bowl with a bottom surface for stable engagement with sand and other unconsolidated soils. A swivel mechanism is secured atop the load-distributing platform. A carriage is secured atop the swivel mechanism and has a number of clips for selective fastening to the legs of a folding, beach chair.

6 Claims, 1 Drawing Sheet

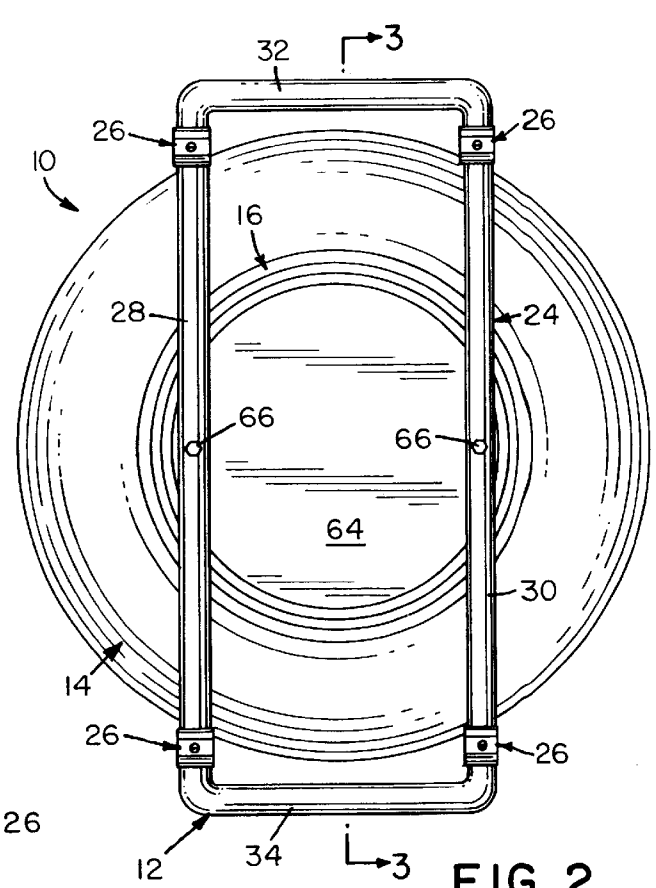
FIG. 1
FIG. 2
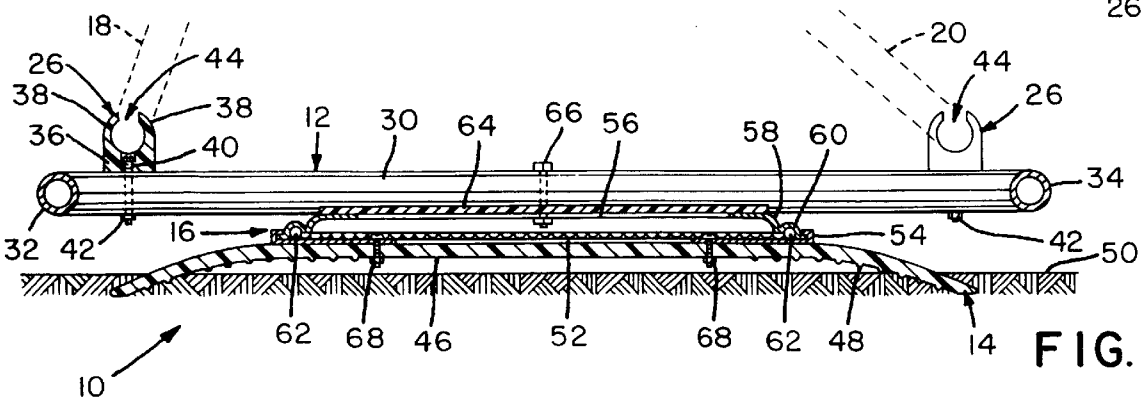
FIG. 3

DETACHABLE SWIVEL APPARATUS FOR A BEACH CHAIR

FIELD OF THE INVENTION

The present invention relates generally to chairs and seats and, in particular, to an apparatus for moving the bottom and back of a chair as a unit about a vertical axis.

BACKGROUND OF THE INVENTION

Products which permit beach chairs to be swiveled have been proposed in the past. These products, unfortunately, have not been particularly well adapted for use on unconsolidated ground as is found at a beach. They tend to have narrow supports which slide upon, and sink unevenly into, sand thereby making the swiveling of a chair uncomfortable. A need, therefore, exists for a swivel apparatus which will provide maximum stability for a beach chair on sand and the like.

SUMMARY OF THE INVENTION

In light of the problems associated with the known beach chair swiveling products, it is a principal object of the invention to provide a swivel apparatus for a chair which will support itself atop sand, as is found at a beach, with a minimum of penetration into the sand and with a minimum of lateral sliding during use.

It is another object of the invention to provide a swivel apparatus of the type described which is easily attached and detached from a folding, beach chair so as to permit its conversion to a swivel chair. Attachment and detachment may be quickly accomplished by a user without special tools or training.

It is an object of the invention to provide improved elements and arrangements thereof in a swivel apparatus for the purposes described which is lightweight in construction, inexpensive to manufacture, and dependable in use.

Briefly, the swivel apparatus in accordance with this invention achieves the intended objects by featuring a load-distributing platform being an inverted bowl with a bottom surface for stable engagement with unconsolidated earth. A swivel mechanism is secured atop the load-distributing platform. A carriage is secured atop the swivel mechanism and has a number of clips for selective fastening to the legs of a beach chair.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a perspective view of a detachable swivel apparatus in accordance with the present invention shown attached to a beach chair.

FIG. 2 is a top view of the swivel apparatus of FIG. 1.

FIG. 3 is a cross-sectional view taken along line 3—3 of FIG. 2.

Similar reference characters denote corresponding features consistently throughout the accompanying drawings.

DETAILED DESCRIPTION OF THE PREFERRED EMBODIMENT

Referring now to the FIGS., a swivel apparatus in accordance with the present invention is shown at 10. Apparatus

10 includes a carriage 12 attached to a load-distributing platform 14 by means of a swivel mechanism 16. In use, carriage 12 is selectively fastened to the front and rear legs 18 and 20 of a chair 22 so as to permit the pivoting of chair 22 about a vertical axis.

Carriage 12 includes a rectangular frame 24 having C-shaped clips 26 joined thereto. Preferably, frame 24 has left and right side members 28 and 30 joined by front and rear end members 32 and 34. A pair of clips 26 are positioned atop each of the side members 28 and 30 with one clip 26 being located adjacent end member 32 and the other being near end member 34.

Each clip 26 is formed of resilient plastic and includes a base 36 and a pair of retaining arms 38 extending upwardly from base 36. As shown, each base 36 is provided with an aperture 40 through which a threaded fastener 42 is run to join a clip 26 to frame 24. Arms 38 are located on opposite sides of aperture 40 and have an arcuate shape so as to form an upwardly-opening concavity 44 in each clip 26. Into concavity 44 leg 18 or 20 of chair 22 may be releasably snap-fit.

Load-distributing platform 14 comprises a shallow, inverted bowl about twenty inches (50 cm) in diameter and one and a half inches (3.75 cm) in depth. The bottom surface 46 of platform 14 is generally concave and is provided with a plurality of elevated and concentric bands as at 48 which serve to stiffen platform 14 and limit its sliding on unconsolidated supporting surfaces such as sand 50. Preferably, platform 14 is made from a resilient plastic material.

Swivel mechanism 16 includes a bottom ring 52 with an inwardly-opening peripheral groove 54 and a top ring 56 with a downwardly-extending peripheral edge 58 slidably positioned partially within groove 54. Preferably, the lower surface of edge 58 is provided with a circumferential groove 60 for receiving ball bearings 62 which bear loads placed on ring 56 and permit the free rotation of ring 56 relative to ring 52. (Although not shown, the upper surface of bottom ring 52 may be provided with a circumferential groove like groove 60 to further confine bearings 62.) A dust cover 64 is snugly secured between members 28 and 30 and atop ring 56 to prevent dirt from fouling bearings 62.

Swivel mechanism 16 is secured to carriage 12 and platform 14 by means of threaded fasteners 66 and 68. Threaded fasteners 66 join members 28 and 30 to top ring 56. Threaded fasteners 68 connect the apex of platform 14 to bottom ring 52. Thus, by means swivel mechanism 16, carriage 12 and a chair 22 carried thereby may be swiveled relative to platform 14 positioned on surface 50.

Use of apparatus 10 is straightforward. First, platform 14 is positioned on a supporting surface such as the one shown at 50. Then, the bottom portions of legs 18 and 20 of chair 22 are pushed into concavities 44 of clips 26. Chair 22 may now be swiveled three hundred sixty degrees around a substantially vertical axis. After use, apparatus 10 may be detached from chair 22 by disengaging legs 18 and 20 from clips 26 with a moderate pull. Chair 22 may now be folded for transport and storage with apparatus 10.

While the invention has been described with a high degree of particularity, it will be appreciated by those skilled in the art that modifications may be made thereto. For example, many lightweight structures could be substituted for open-work frame 24 to support clips 26 in locations appropriate to engage chair legs 18 and 20. Similarly, swivel mechanism 16 may be replaced by one of many equivalents known in the art. Therefore, it is to be understood that the present invention is not limited to the sole embodiment described above, but encompasses any and all embodiments within the scope of the following claims.

I claim:

1. A swivel apparatus, comprising:

a load-distributing platform being an inverted bowl having a bottom surface for engagement with an unconsolidated supporting surface, said bottom surface of said load-distributing platform includes a plurality of elevated and concentric bands for stiffening said load-distributing platform and limiting its sliding on the unconsolidated supporting surface;

a swivel mechanism secured atop said load-distributing platform; and, a carriage secured atop said swivel mechanism for selective fastening to the legs of a chair.

2. The swivel apparatus according to claim 1 wherein said carriage includes:

a rectangular frame having a pair of opposed side members joined by front and rear end members; and, a pair of clips positioned atop each of said side members with one of said clips being located adjacent said front end member and the other of said clips being located near said rear end member.

3. The swivel apparatus according to claim 2 wherein each of said clips includes:

a base for positioning atop one of said side members; and, a pair of opposed, retaining arms extending upwardly from said base, each of said retaining arms having an arcuate shape so as to form an upwardly-opening concavity therebetween into which a chair leg may be releasably snap-fit.

4. A swivel apparatus, comprising:

a load-distributing platform being an inverted bowl having a bottom surface for engagement with an unconsolidated supporting surface;

a swivel mechanism secured atop said load-distributing platform;

a carriage atop said swivel mechanism having a plurality of clips for selective fastening to the legs of a chair, said carriage including:

a rigid frame having pair of opposed side members joined by front and rear end members; and, a plurality of clips positioned atop said frame, each of said clips having a pair of opposed, upwardly-extending, retaining arms, each of said retaining arms having an arcuate shape so as to form an upwardly-opening concavity therebetween into which a chair leg may be releasably snap-fit.

5. The swivel apparatus according to claim 4 wherein said bottom surface of said load-distributing platform includes a plurality of elevated and concentric bands for stiffening said load-distributing platform and limiting its sliding on unconsolidated supporting surfaces.

6. A swivel apparatus, comprising:

a load-distributing platform being an inverted bowl having a bottom surface for engagement with an unconsolidated supporting surface, said bottom surface having a plurality of elevated and concentric bands for stiffening said load-distributing platform and limiting its sliding on unconsolidated supporting surfaces;

a swivel mechanism secured atop said load-distributing platform;

a carriage secured atop said swivel mechanism having a plurality of clips for selective fastening to the legs of a chair, said carriage including:

a rectangular frame having pair of opposed side members joined by front and rear end members; and, a pair of clips positioned atop each of said side members with one of said clips being located adjacent said front end member and the other of said clips being located near said rear end member, each of said clips including:

a base for positioning atop one of said side members; and, a pair of opposed, retaining arms extending upwardly from said base, each of said retaining arms having an arcuate shape so as to form an upwardly-opening concavity therebetween into which a chair leg may be releasably snap-fit.

* * * * *